US007559505B2

(12) United States Patent
Janka

(10) Patent No.: US 7,559,505 B2
(45) Date of Patent: Jul. 14, 2009

(54) APPARATUS AND METHOD FOR RESTRAINING AND DEPLOYING AN AIRFOIL

(75) Inventor: Ronald E. Janka, Grapevine, TX (US)

(73) Assignee: Lockheed Martin Corporation, Grand Prairie, TX (US)

( * ) Notice: Subject to any disclaimer, the term of this patent is extended or adjusted under 35 U.S.C. 154(b) by 413 days.

(21) Appl. No.: 11/292,226

(22) Filed: Dec. 1, 2005

(65) Prior Publication Data

US 2007/0125904 A1 Jun. 7, 2007

(51) Int. Cl.
*F42B 15/01* (2006.01)
*B64C 3/56* (2006.01)

(52) U.S. Cl. ..... 244/3.28; 244/46

(58) Field of Classification Search ..... 244/3.24, 244/3.29, 3.28, 48, 46, 218, 155 A; 89/1.4, 89/1.14

See application file for complete search history.

(56) References Cited

U.S. PATENT DOCUMENTS

| | | | | | |
|---|---|---|---|---|---|
| 1,732,581 | A | | 10/1929 | Johnson | 403/275 |
| 2,060,864 | A | | 11/1936 | Hedler | 403/275 |
| 2,420,987 | A | | 5/1947 | Temple, Jr. | 114/221 A |
| 2,610,376 | A | | 9/1952 | Murana | 403/275 |
| 2,939,732 | A | | 6/1960 | Rochester | 403/275 |
| 3,074,320 | A | | 1/1963 | Trifonoff | 89/1.51 |
| 3,135,482 | A | * | 6/1964 | Ghard | 244/218 |
| 3,267,539 | A | | 8/1966 | Mark | 403/275 |
| 3,286,630 | A | | 11/1966 | Salmirs et al. | 102/377 |
| 3,304,030 | A | | 2/1967 | Weimholt et al. | 244/3.28 |
| 3,393,605 | A | | 7/1968 | Parnell | 98/1.14 |
| 3,415,467 | A | * | 12/1968 | Barringer | 244/3.29 |
| 3,501,115 | A | * | 3/1970 | Deplante | 244/46 |
| 3,563,495 | A | | 2/1971 | Korn | 244/3.29 |
| 3,838,940 | A | | 10/1974 | Hollrock | 416/142 |
| 3,991,649 | A | | 11/1976 | Patrichi | 89/1.14 |

(Continued)

FOREIGN PATENT DOCUMENTS

DE 3215432 A1 10/1983

(Continued)

OTHER PUBLICATIONS

Patent Abstracts of Japan, Application No. 63296140, dated Nov. 25, 1988, entitled "Guided Missile".

(Continued)

*Primary Examiner*—Tien Dinh
(74) *Attorney, Agent, or Firm*—Daren C. Davis; James E. Walton

(57) ABSTRACT

An apparatus includes means for biasing a first airfoil of a vehicle toward a fully deployed position, means for restraining the first airfoil in a stowed position, means for releasing the first airfoil from the stowed position, means for restraining the first airfoil in a partially deployed position, and means for releasing the first airfoil from the partially deployed position. A method includes restraining an airfoil in a stowed position, releasing the airfoil from the stowed position, and biasing the airfoil from the stowed position toward a fully deployed position. The method further includes restraining the airfoil in a partially deployed position, releasing the airfoil from the partially deployed position, and biasing the airfoil from the partially deployed position toward the fully deployed position.

16 Claims, 8 Drawing Sheets

U.S. PATENT DOCUMENTS

| | | | | |
|---|---|---|---|---|
| 4,062,112 | A | 12/1977 | Lake | 30/228 |
| 4,116,130 | A | 9/1978 | Christopher et al. | 102/307 |
| 4,128,071 | A | 12/1978 | Layman et al. | 114/221 A |
| 4,426,053 | A | 1/1984 | Chenin et al. | 244/173 |
| 4,495,849 | A | 1/1985 | Cooke et al. | 89/1.14 |
| 4,588,146 | A | 5/1986 | Schaeffel et al. | 244/3.27 |
| 4,778,127 | A | 10/1988 | Duchesneau | 244/3.29 |
| 4,884,766 | A | 12/1989 | Steinmetz et al. | 244/3.27 |
| 5,009,374 | A | 4/1991 | Manfredi et al. | 244/1 R |
| 5,177,317 | A | 1/1993 | Walker et al. | 89/1.14 |
| 5,361,676 | A | 11/1994 | Gibbs | 89/1.14 |
| 5,364,046 | A | 11/1994 | Dobbs et al. | 244/161 |
| 5,368,255 | A | 11/1994 | August | 244/3.28 |
| 5,582,364 | A | 12/1996 | Trulin et al. | 244/3.29 |
| 5,950,963 | A | 9/1999 | Speicher et al. | 244/3.21 |
| 6,119,986 | A * | 9/2000 | Stribling, Jr. | 244/172.8 |
| 6,250,584 | B1 | 6/2001 | Hsu et al. | 244/3.24 |
| 6,352,217 | B1 | 3/2002 | Hsu et al. | 244/3.24 |
| 6,439,122 | B1 | 8/2002 | Nygren et al. | 102/377 |
| 7,338,010 | B2 * | 3/2008 | Corder et al. | 244/3.28 |
| 2004/0007123 | A1 | 1/2004 | Ritchie et al. | 89/1.14 |
| 2004/0159227 | A1 * | 8/2004 | Richards | 89/1.4 |

FOREIGN PATENT DOCUMENTS

| | | | |
|---|---|---|---|
| DE | 3818669 | C | 8/1989 |
| FR | 2319823 | A | 4/1977 |
| GB | 1350047 | | 4/1974 |
| GB | 2140136 | A | 11/1984 |
| JP | 05213291 | A | 8/1993 |

OTHER PUBLICATIONS

WO 00/48778, Published Aug. 24, 2000, Entitled "Controlled Rupture Device for a Structure Operating in Traction and Equipment Using Same," Etienne Lacroix Tous Artifices S.A.

* cited by examiner

APPARATUS AND METHOD FOR RESTRAINING AND DEPLOYING AN AIRFOIL

STATEMENT REGARDING FEDERALLY SPONSORED RESEARCH OR DEVELOPMENT

The U.S. Government has a paid-up license in this invention and the right in limited circumstances to require the patent owner to license others on reasonable terms as provided for by the terms of contract number F08630-03-D-0103 0001 awarded by the United States Air Force.

BACKGROUND

1. Field of the Invention

The present invention relates to airfoils. In particular, the present invention relates to an apparatus for restraining and deploying an airfoil and a method of using the apparatus.

2. Description of Related Art

Vehicles that traverse a fluid medium, such as rockets, missiles, projectiles, torpedoes, pods, drones, and the like generally have one or more airfoils, such as wings, fins, or other such control surfaces, which are used to stabilize and/or steer the vehicle as it moves through the fluid medium. It is often desirable to fold, rotate, or pivot such control surfaces so that the vehicle can be stored in a smaller space, such as within a munitions dispenser, a munition ejector rack, an aircraft internal weapons bay carriage, a rocket, a missile, a launch canister, or the like. When such a vehicle is launched, biasing members, such as springs, are used to urge the control surfaces into their flight or operational configurations.

Conventional airfoil deployment mechanisms urge the airfoils associated therewith in one step from a stowed or folded configuration to a deployed or unfolded configuration. In other words, when a conventional airfoil deployment mechanism is activated, the airfoil or airfoils associated with the deployment mechanism are released and move to their unfolded, fully deployed configurations. Typically, the airfoils of such a vehicle are configured to the unfolded position just after the vehicle is deployed. Because the vehicle's deployment velocity is often slow relative to the operational velocity of the vehicle, the airfoils present significant aerodynamic drag. Accordingly, the vehicle may have difficulties in attaining aerodynamic stability.

Moreover, when conventional, stowable airfoils are deployed, their positions may oscillate between the fully deployed positions and positions just short of the fully deployed positions. Such oscillations result in changes to the aerodynamic characteristics of the airfoils and inefficient airfoil aerodynamic operation.

Clips or other such structures are often used to restrain the control surfaces in their stowed configuration. When the vehicle is launched, the clips are removed from the vehicle, often by the launcher, which allows the control surfaces to be urged into their flight or operational configuration.

Problems may arise, however, if one or more of the clips are not removed from the vehicle. In such a situation, the restrained control surface may inhibit the launched vehicle's ability to properly maneuver, causing the vehicle to become aerodynamically or hydrodynamically unstable. The removed clips may also cause damage if they impact other equipment near the launch site.

In some conventional designs, retractable pins are used to restrain the control surfaces in their stowed configuration. Upon launching the vehicle, the pins are retracted by an actuator, which allows the control surfaces to move to their flight or operational configurations. Such restraining systems are often bulky and heavy, which may impact the performance of the vehicle.

While there are many ways known in the art to restrain and deploy airfoils, considerable room for improvement remains.

SUMMARY OF THE INVENTION

There is a need for an improved apparatus and method for restraining and deploying an airfoil.

Therefore, it is an object of the present invention to provide an improved apparatus and method for restraining and deploying an airfoil.

These and other objects are achieved by providing, in one aspect, an apparatus, including means for biasing a first airfoil of a vehicle toward a fully deployed position, means for restraining the first airfoil in a stowed position, means for releasing the first airfoil from the stowed position, means for restraining the first airfoil in a partially deployed position, and means for releasing the first airfoil from the partially deployed position.

In another aspect of the present invention, a vehicle is provided, including a body, a first airfoil rotationally mounted to the body, and means for biasing the first airfoil toward a first airfoil fully deployed position. The vehicle further includes means for restraining the first airfoil in a first airfoil stowed position, means for releasing the first airfoil from the first airfoil stowed position, means for restraining the first airfoil in a first airfoil partially deployed position, and means for releasing the first airfoil from the first airfoil partially deployed position.

In yet another aspect, the present invention provides an apparatus, including a biasing element operably associated with a first airfoil and a body of a vehicle operable to bias the first airfoil toward a fully deployed position and a first tether operably associated with the first airfoil and one of a second airfoil and the body of the vehicle, the first tether operable to restrain the first airfoil in a stowed position. The apparatus further includes a first tether severing mechanism operable to sever the first tether, a second tether operably associated with the first airfoil and one of the second airfoil and the body of the vehicle, the second tether operable to restrain the first airfoil in a partially deployed position, and a second tether severing mechanism operable to sever the second tether.

In another aspect of the present invention, a method is provided, including restraining an airfoil in a stowed position, releasing the airfoil from the stowed position, and biasing the airfoil from the stowed position toward a fully deployed position. The method further includes restraining the airfoil in a partially deployed position, releasing the airfoil from the partially deployed position, and biasing the airfoil from the partially deployed position toward the fully deployed position.

The present invention provides significant advantages, including: (1) providing a means to stow airfoils of a vehicle without the use of clips or the like; (2) allowing a vehicle to become aerodynamically stable with airfoils of the vehicle only partially deployed; and (3) damping rotational oscillations in the airfoils of a vehicle.

Additional objectives, features and advantages will be apparent in the written description which follows.

DESCRIPTION OF THE DRAWINGS

The novel features believed characteristic of the invention are set forth in the appended claims. However, the invention itself, as well as, a preferred mode of use, and further objectives and advantages thereof, will best be understood by reference to the following detailed description when read in conjunction with the accompanying drawings, wherein:

Figure 1:
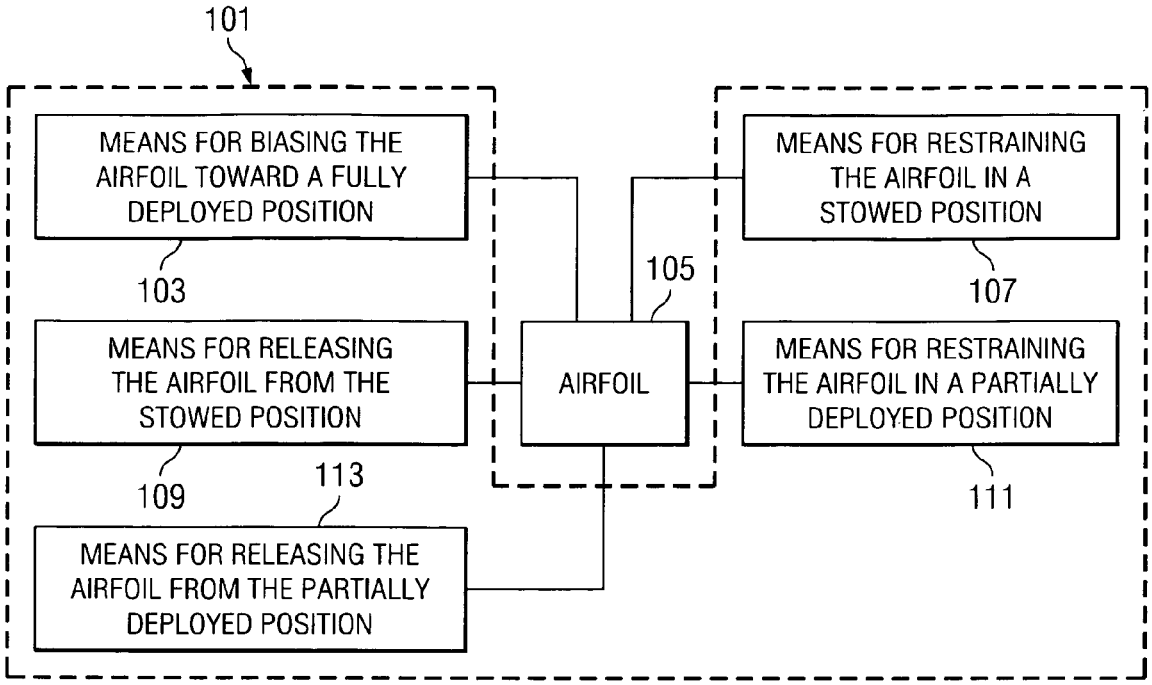
FIG. 1 is a block diagram illustrating one particular embodiment of an apparatus for restraining and releasing an airfoil according to the present invention.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE PREFERRED EMBODIMENT

Illustrative embodiments of the invention are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

The present invention represents an apparatus for restraining and deploying one or more airfoils of a vehicle and a method of using the apparatus. Generally, the apparatus restrains one or more airfoils in fully stowed positions until such time that the airfoils are to be deployed. When the airfoils are to be deployed, the apparatus urges the airfoils to intermediate positions between the stowed positions and fully deployed positions. Preferably, the deployment of the airfoils to the intermediate positions is accomplished just after the vehicle is ejected from a retaining device. Examples of such retaining devices include, but are not limited to, a munitions dispenser, a munition ejector rack, a pylon, an aircraft internal weapons bay carriage, a rocket, a missile, a torpedo tube, a launch canister, or the like.

Preferably, the airfoils are restrained in the intermediate positions for a period of time sufficient for the vehicle to attain aerodynamic stability. After this time period has elapsed, the apparatus of the present invention then urges the airfoils to fully deployed positions. The restraining and deployment apparatus of the present invention dampens oscillations about their rotational or folding axes that may occur. Specifically, such oscillations are inhibited by the apparatus of the present invention when the airfoils reach the intermediate positions and/or when the airfoils reach the fully deployed positions.

It should be noted that the apparatus for restraining and deploying an airfoil according to the present invention may, in various embodiments, operate a single airfoil or a plurality of airfoils. For example, in the illustrative embodiment shown in FIG. 1, an apparatus 101 comprises a means 103 for biasing an airfoil 105 toward a fully deployed position, a means 107 for restraining airfoil 105 in a stowed position, a means 109 for releasing airfoil 105 from the stowed position, a means 111 for restraining airfoil 105 in a partially deployed position, and a means 113 for releasing airfoil 105 from the partially deployed position to the fully deployed position. In another embodiment, depicted in FIG. 2, an apparatus 201 comprises a means 203 for biasing a plurality of airfoils 205 toward fully deployed positions, a means 207 for restraining plurality of airfoils 205 in stowed positions, a means 209 for releasing plurality of airfoils 205 from the stowed positions, a means 211 for restraining plurality of airfoils 205 in partially deployed positions, and a means 213 for releasing plurality of airfoils 205 from the partially deployed positions to the fully deployed positions.

Figure 2:
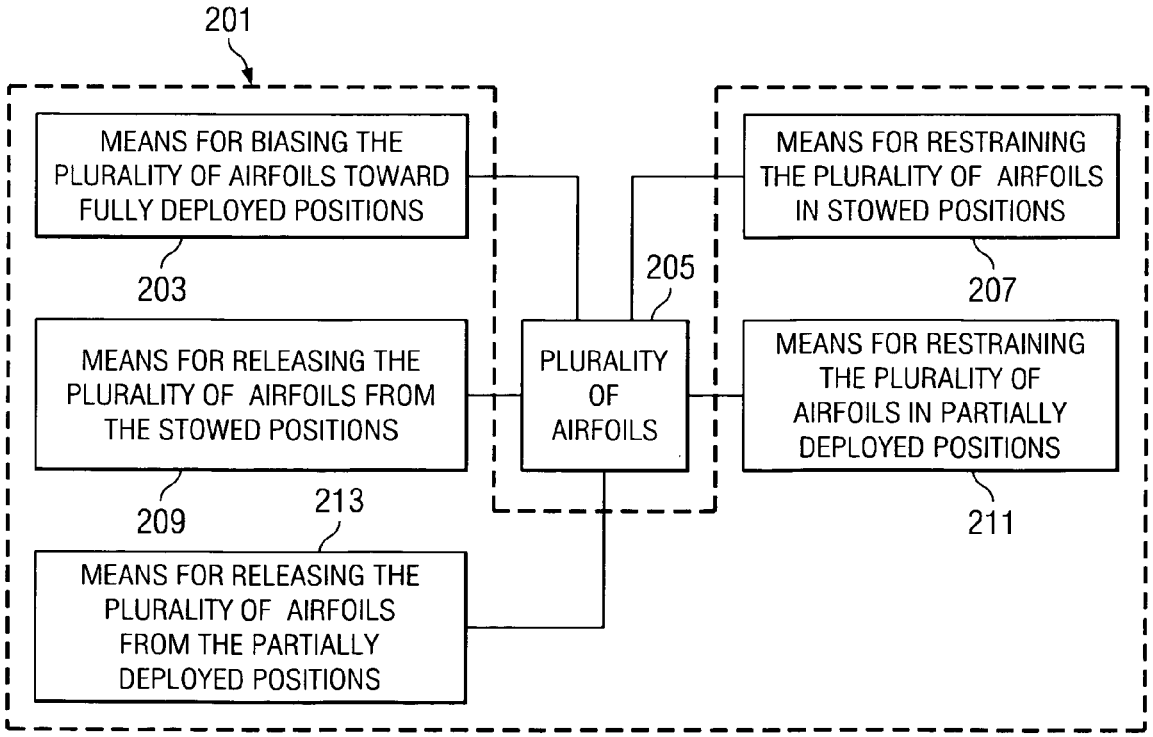
FIG. 2 is a block diagram illustrating one particular embodiment of an apparatus for restraining and releasing a plurality of airfoils according to the present invention.
Figure 3:
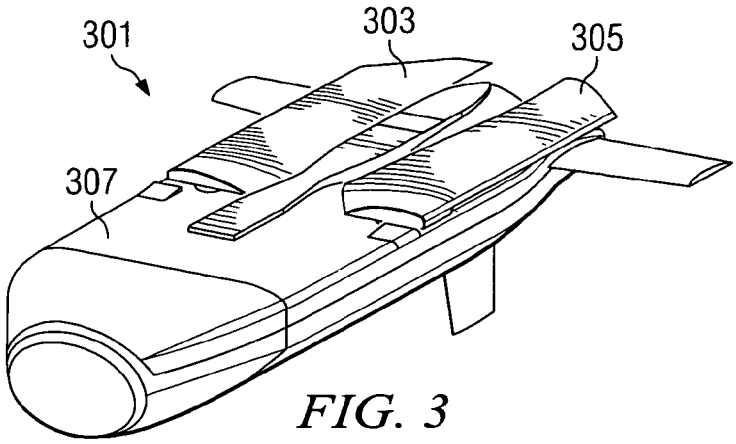
FIG. 3 is a perspective view of an illustrative embodiment of a vehicle of the present invention incorporating the apparatus of FIG. 2, showing airfoils of the vehicle in stowed positions.
Figure 4:
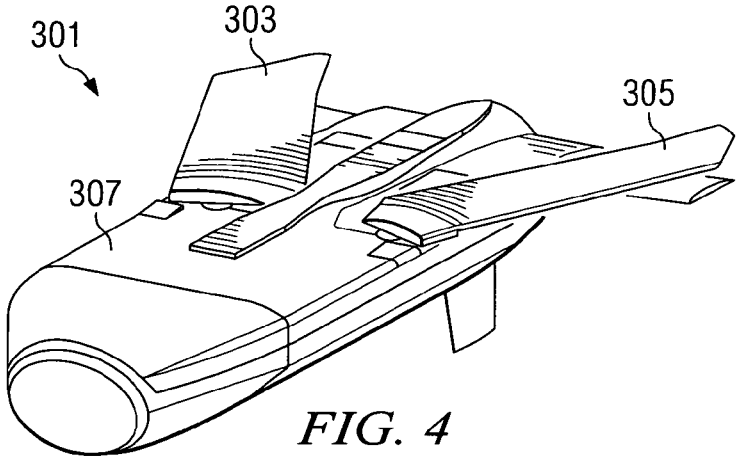
FIG. 4 is a perspective view of the vehicle of FIG. 3 illustrating the airfoils of the vehicle in partially deployed positions.
Figure 5:
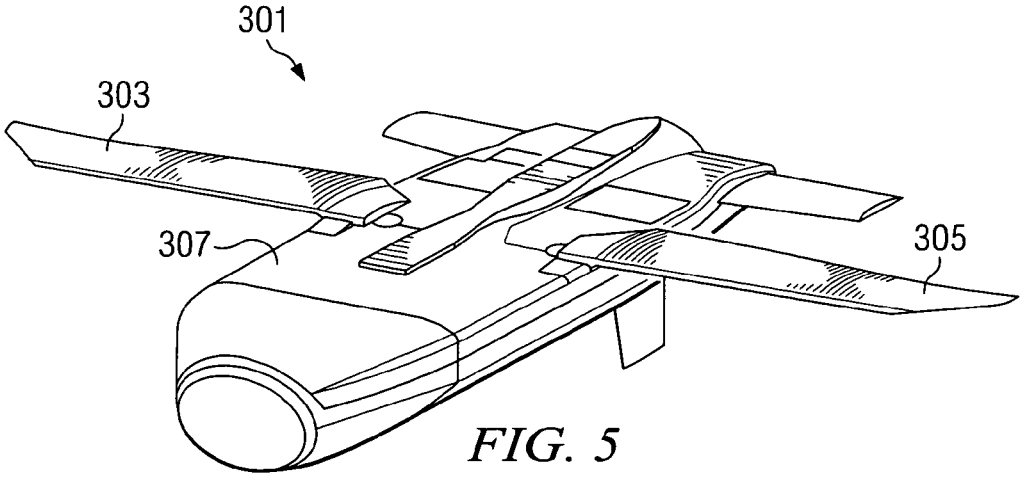
FIG. 5 is a perspective view of the vehicle of FIG. 3 illustrating the airfoils of the vehicle in fully deployed positions.
Figure 6A:
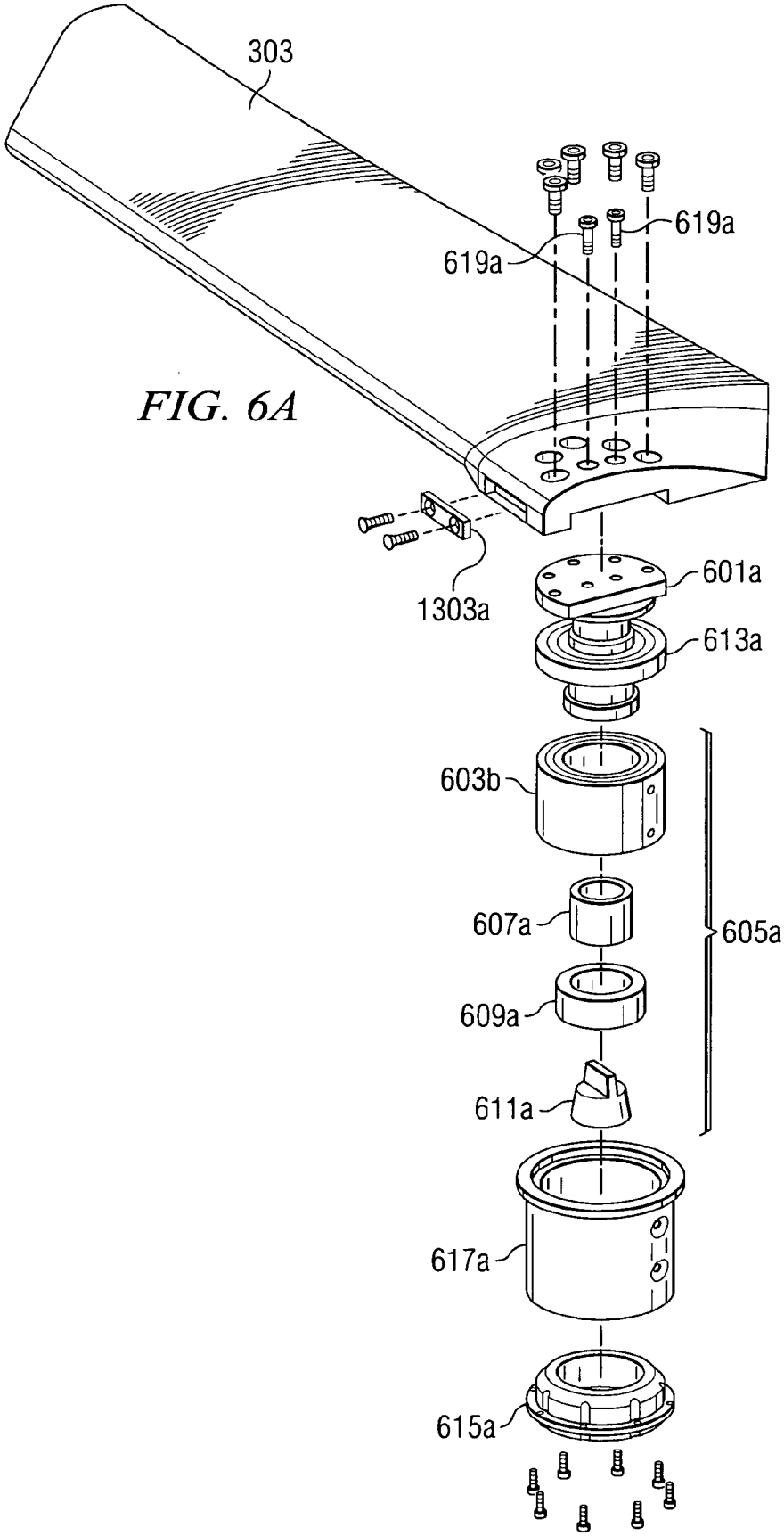
FIG. 6A is an exploded, perspective view of an illustrative embodiment of a mechanism according to the present invention operably associating a first airfoil with a body of the vehicle, both of FIG. 3.
Figure 6B:
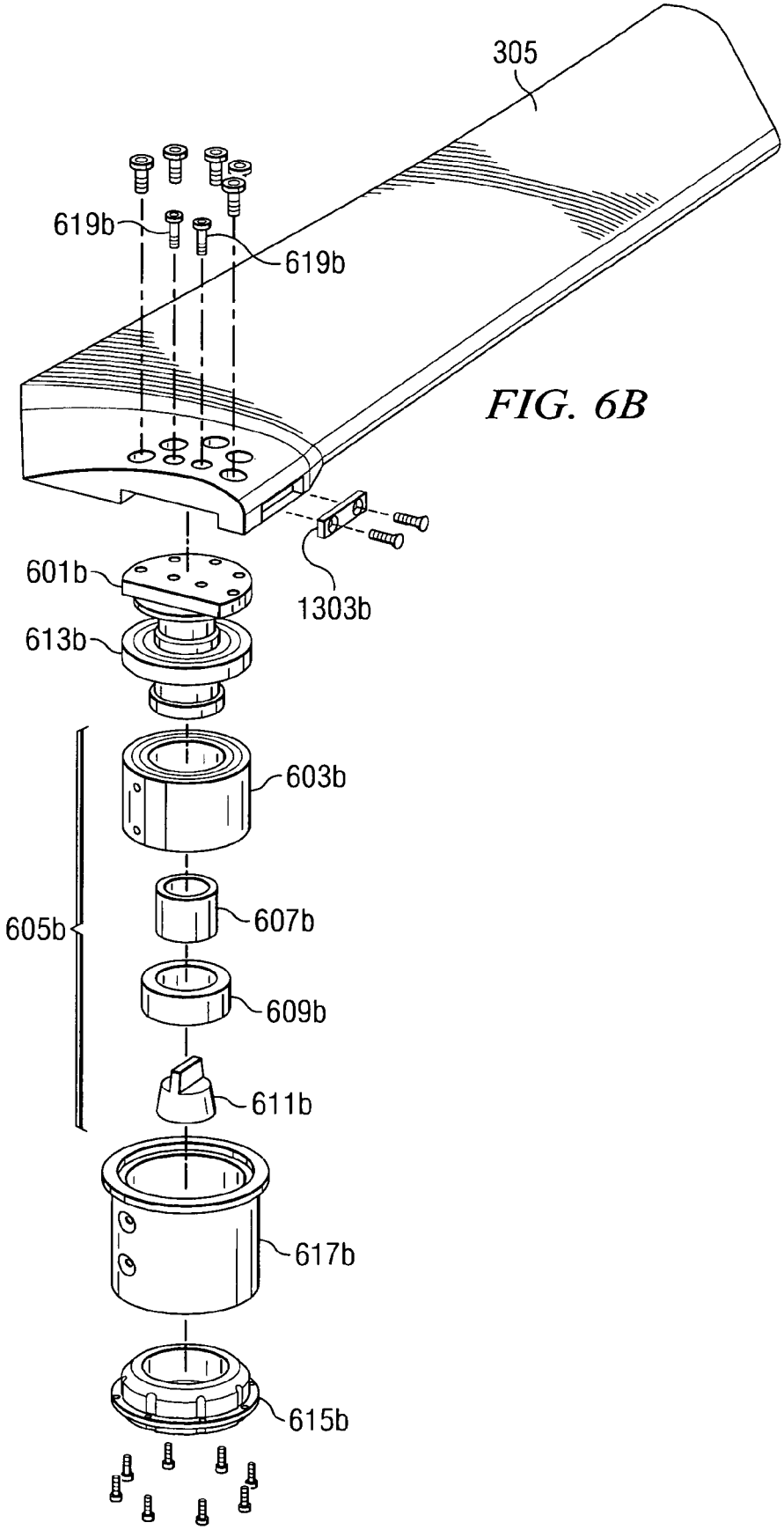
FIG. 6B is an exploded, perspective view of an illustrative embodiment of a mechanism according to the present invention operably associating a second airfoil with a body of the vehicle, both of FIG. 3.

FIGS. 3-5 depict a vehicle 301 according to the present invention comprising a first airfoil 303 and a second airfoil 305, each rotatably coupled with a body 307. In FIG. 3, first airfoil 303 and second airfoil 305 are disposed in stowed positions. In FIG. 2, first airfoil 303 and second airfoil 305 are disposed in partially deployed positions. In FIG. 3, first airfoil 303 and second airfoil 305 are disposed in fully deployed positions. The apparatus of the present invention will be described below in relation to the vehicle 301, in that both airfoils 303, 305 are restrained and deployed. The scope of the present invention, however, encompasses the present invention being configured to operate only one of airfoils 303, 305. Moreover, the scope of the present invention encompasses the apparatus of the present invention being configured to operate one or more airfoils that are of different configurations, types, or shapes than airfoils 303, 305. Furthermore, in at least one embodiment, the scope of the present invention encompasses a vehicle, such as vehicle 301, that incorporates the apparatus 101 of FIG. 1 for restraining and deploying an airfoil, such as one of airfoils 303, 305 of FIGS. 3-5, or the apparatus 201 of FIG. 2 for restraining and deploying a plurality of airfoils, such as airfoils 303, 305 of FIGS. 3-5.

While the apparatus of the present invention may take on many different forms, particular preferred embodiments are illustrated in FIGS. 6-14 and discussed herein below. Turning now to FIGS. 6A and 6B, an axle 601a extends from airfoil 303 and an axle 601*b* extends from an airfoil 305. Axles 601*a*, 601*b* are attached through other elements of the present invention to body 307 of vehicle 301 (shown in FIGS. 3-5), as will be discussed in greater detail below. Airfoil 303 rotates with respect to body 307 via axle 601*a* and airfoil 305 rotates with respect to body 307 via axle 601*b*. Axle 601*a* is also attached to a biasing element 603*a* that is, by way of example and illustration, one particular means for biasing airfoil 303 toward a fully deployed position. Axle 601*b* is attached to a biasing element 603*b* that is, by way of example and illustration, one particular means for biasing airfoil 305 toward a fully deployed position. In embodiments, wherein the apparatus of the present invention operates a plurality of airfoils, biasing elements 603*a*, 603*b* are, by way of example and illustration, one particular means for biasing airfoils 303, 305 toward fully deployed positions. In one embodiment, biasing elements 601*a*, 601*b* comprise spirally-wound strip springs.

Figure 7:
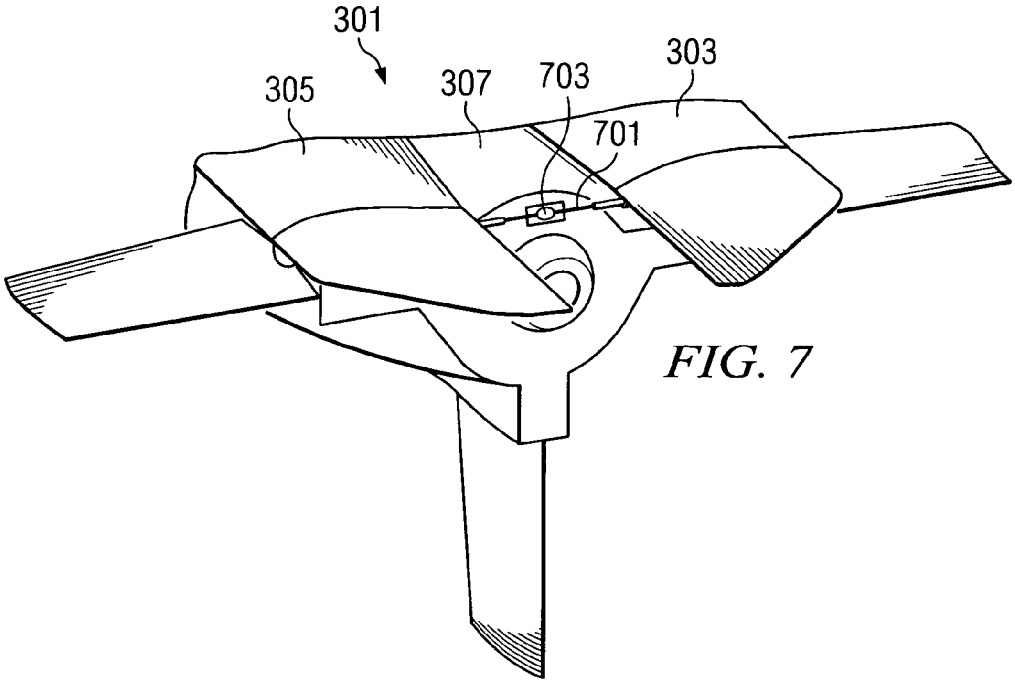
FIG. 7 is a rear, perspective view of the vehicle of FIG. 3 illustrating a first tether and a first tether severing mechanism of the present invention.
Figure 8A:
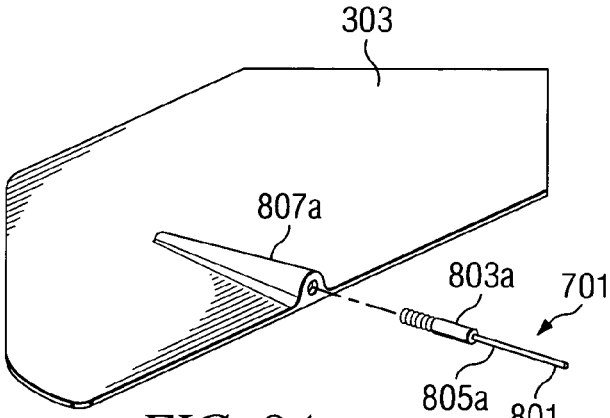
FIG. 8A is a perspective view of one particular implementation of the first airfoil and the first tether of the present invention.
Figure 9:
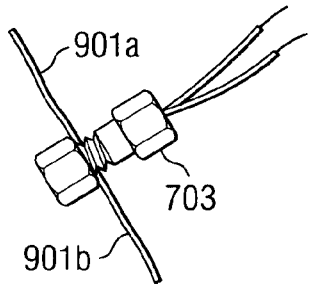
FIG. 9 is a side view illustrating one particular relationship according to the present invention between the first tether severing mechanism and the first tether.
Figure 8B:
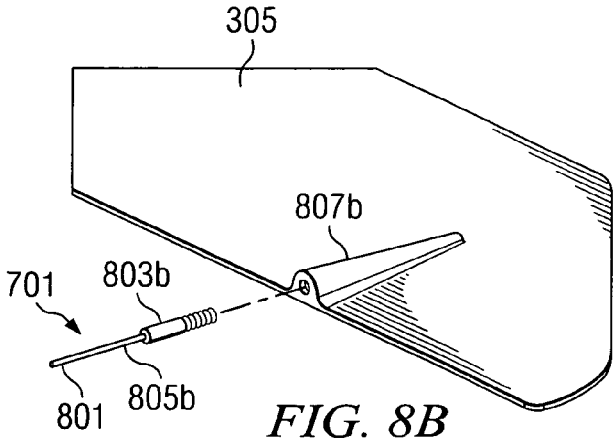
FIG. 8B is a perspective view of one particular implementation of the second airfoil and the first tether of the present invention.

Referring now to FIG. 7, one particular means for restraining airfoils 303, 305 in stowed positions is illustrated by way of example and illustration. In the illustrated embodiment, a first tether 701 is attached to first airfoil 303 and second airfoil 305. First tether 701 is sized to retain first airfoil 303 and second airfoil 305 in the stowed positions (such as shown in FIG. 3). In one embodiment, shown in FIGS. 8A and 8B, first tether 701 comprises a cable 801, a first fitting 803*a*, and a second fitting 803*b*. First fitting 803*a* is attached to a first end 805*a* of cable 801 and is adapted to engage a boss 807*a* defined by first airfoil 303. Second fitting 803*b* is attached to a second end 805*b* of cable 801 and is adapted to engage a boss 807*b* defined by second airfoil 305. Note that the configurations of first tether 701, first airfoil 303 and second airfoil 305 are not limited to those shown in FIGS. 8A and 8B.

In embodiments wherein airfoils 303, 305 cannot rotate beyond the stowed positions in directions away from the fully deployed positions, first tether 701 is but one means for restraining first airfoil 303 and second airfoil 305 in stowed positions. In embodiments wherein airfoils 303, 305 can rotate beyond the stowed positions in directions away from the fully deployed positions, first tether 701 and biasing element 603 provide, in combination, one means for restraining airfoils 303, 305 in the stowed positions.

It should be noted that, in one configuration, first tether 701 is attached between body 307 of vehicle 301 and one of airfoils 303, 305. In such a configuration, one of airfoils 303, 305 are restrained in the stowed position.

Referring again to FIG. 7, the present invention further comprises a first tether severing mechanism 703 operable to sever first tether 701 at a desired time. In the embodiment illustrated in FIG. 9, first tether 701 extends through first tether severing mechanism 703, which is an electrically-actuated, explosive-driven severing mechanism, such as those offered by Cartridge Actuated Devices, Inc. of Fairfield, N.J. When first tether severing mechanism 703 is operated, first tether 701 is severed into at least two portions 901*a*, 901*b*, thus releasing airfoils 303, 305 from the stowed positions. Note that, if first tether 701 is attached between body 307 and one of airfoils 303, 305, airfoil 303 or airfoil 305 to which first tether 701 is attached is released from the stowed position. Therefore, by way of example and illustration, first tether severing mechanism 703 is but one means for releasing an airfoil from the stowed position. Preferably, first tether severing mechanism 703 is attached to body 307 of vehicle 301.

Figure 10:
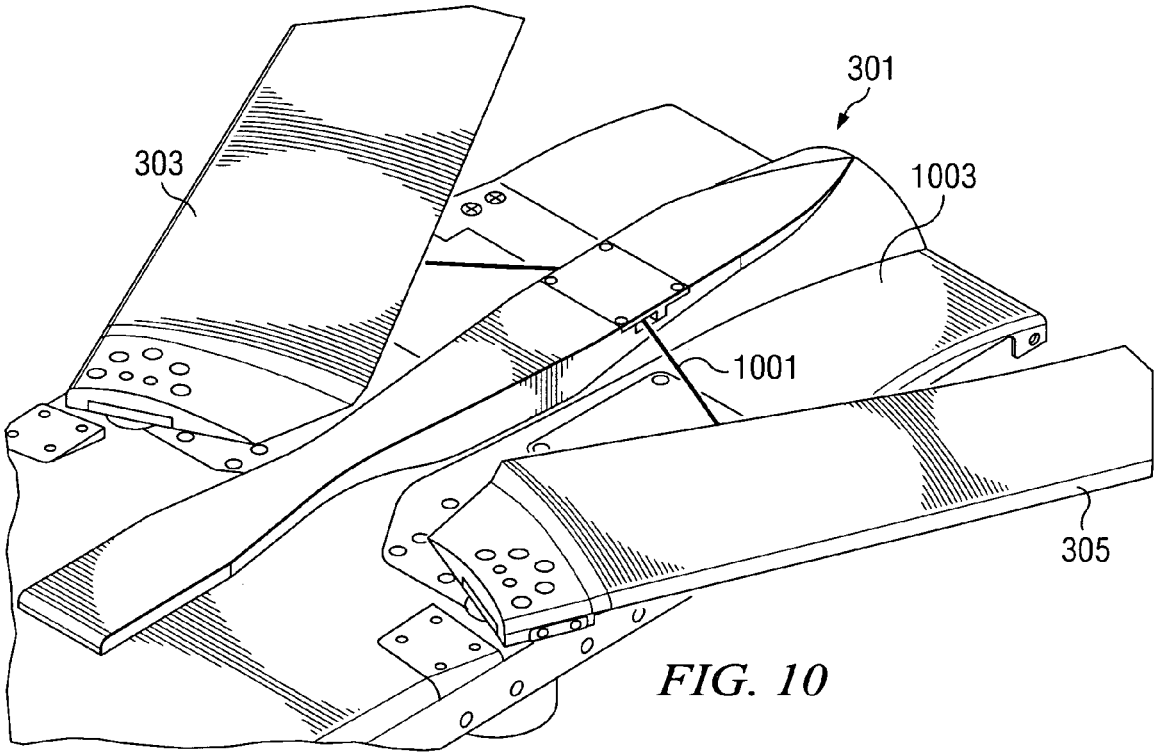
FIG. 10 is a perspective view illustrating a second tether and a relationship between the second tether and the first and second airfoils, all of the present invention.

In the illustrated embodiment, upon the release of airfoils 303, 305 from the stowed position, biasing elements 603*a*, 603*b* bias airfoils 303, 305 toward the fully deployed positions. However, as illustrated in FIG. 10, a second tether 1001 is attached between airfoils 303, 305 and, thus, inhibits airfoils 303, 305 from rotating beyond the partially deployed positions toward the fully deployed positions. Biasing elements 603*a*, 603*b*, operably associated with airfoils 303, 305, respectively, inhibit airfoils 303, 305 from rotating beyond the partially deployed positions away from the fully deployed positions. Thus, by way of example and illustration, second tether 1001 and biasing elements 603*a*, 603*b* provide but one means for restraining airfoils 303, 305 in the partially deployed positions. In one embodiment, second tether 1001 has a configuration corresponding to that of first tether 701, shown in FIGS. 8A and 8B. Note that in FIG. 10, only an upper shell 1003 of body 307 is depicted.

It should be noted that, in one configuration, second tether 1001 is attached between body 307 of vehicle 301 and one of airfoils 303, 305. In such a configuration, one of airfoils 303, 305 are restrained in the partially deployed position.

Figure 11A:
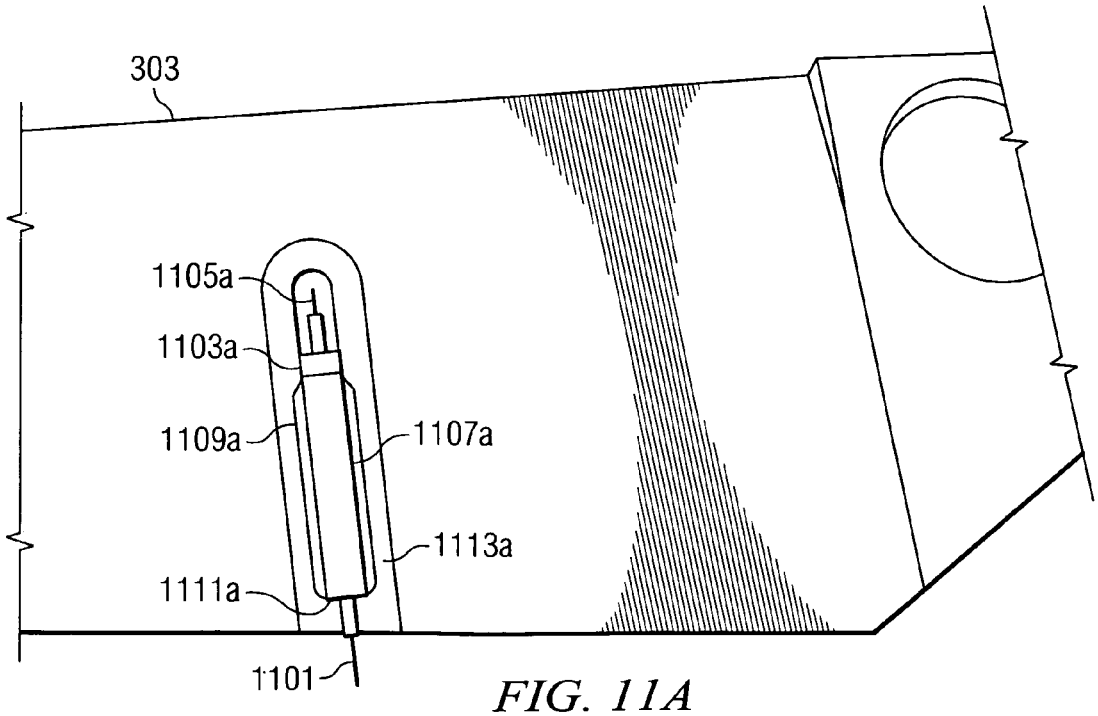
FIGS. 11A and 11B are bottom, plan views of one particular embodiment of the first and second airfoils and the second tether, all according to the present invention.
Figure 11B:
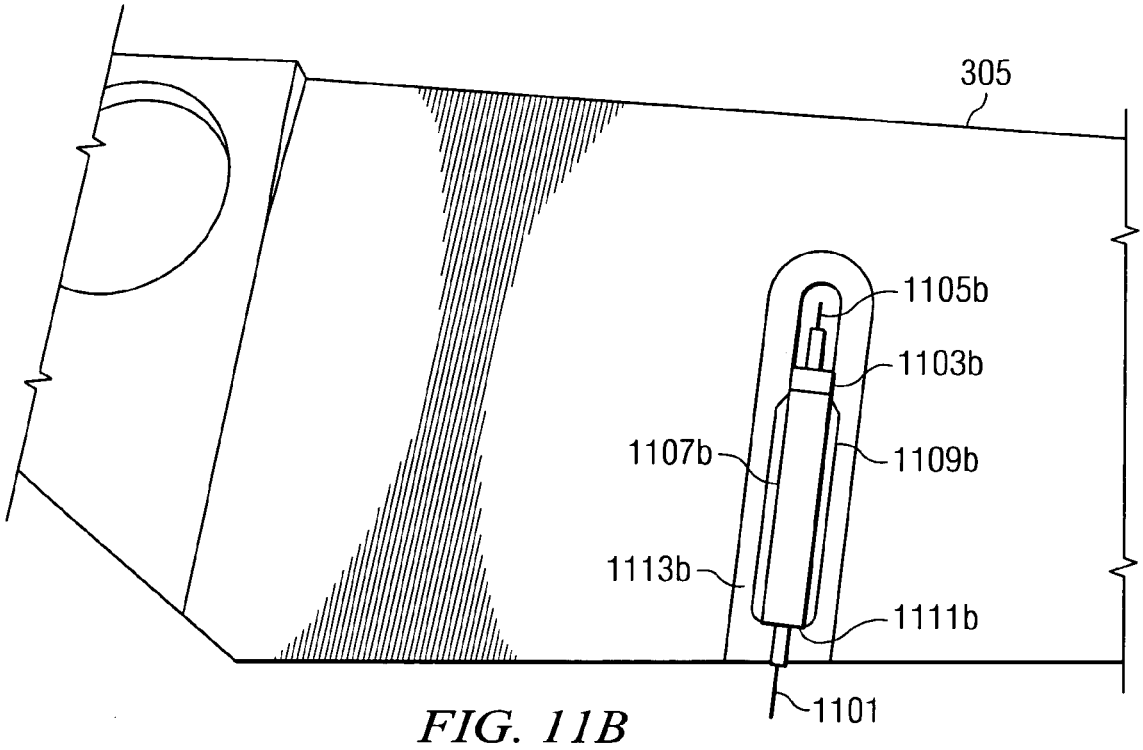

Preferably, second tether 1001 is attached to airfoil 303 as shown in FIG. 11A and second tether 1001 is attached to airfoil 305 as shown in FIG. 11B. In the illustrated embodiment, second tether 1001 comprises a cable 1101 attached to fittings 1103*a*, 1103*b* proximate ends 1105*a*, 1105*b* of cable 1101. Cable 1101 extends though elastic tubes 1107*a*, 1107*b*, which abut fittings 1103*a*, 1103*b*. With cable 1101 etending into airfoils 303, 305, elastic tubes 1107*a*, 1107*b* and fittings 1103*a*, 1103*b* are received in cavities 1109*a*, 1109*b* defined by airfoils 303, 305, respectively. Elastic tubes 1107*a*, 1107*b* abut walls 1111*a*, 1111*b* of cavities 1109*a*, 1109*b*, respectively, which inhibit elastic tubes 1107*a*, 1107*b*; fittings 1103*a*, 1103*b*; and cable 1101 from being withdrawn from airfoils 303, 305. Covers, which are removed in FIGS. 11A and 11B, are disposed in recesses 1113*a*, 1113*b* to retain fittings 1103*a*, 1103*b* and elastic tubes 1107*a*, 1107*b* in cavities 1109*a*, 1109*b*.

When first tether 701 is severed by first tether severing mechanism 703, biasing elements 603*a*, 603*b* bias airfoils 303, 305, respectively, toward the fully deployed positions but are restrained in the partially deployed positions by second tether 1001. Because elastic tubes 1107*a*, 1107*b* are disposed between fittings 1103*a*, 1103*b* and airfoils 303, 305, oscillations due to the halting of movement of airfoils 303, 305 are dampened. Moreover, elastic tubes 1107*a*, 1107*b* attenuate the shock induced in second tether 1001 due to the halting of movement of airfoils 303, 305. Elastic tubes 1107*a*, 1107*b* are, by way of example and illustration, one particular means for damping oscillations in airfoils 303, 305 and are, by way of example and illustration, one particular means for attenuating mechanical shock induced in second tether 1001.

Figure 12:
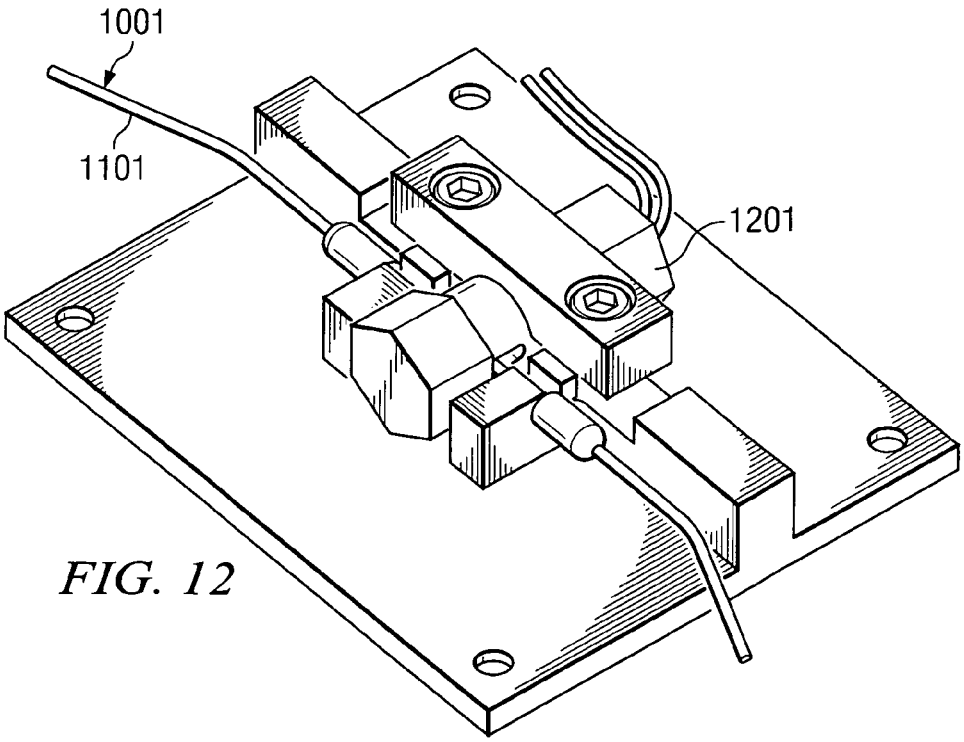
FIG. 12 is a perspective view of an illustrative embodiment of a second tether severing mechanism according to the present invention.

At a desired point in time, such as after vehicle 301 has attained aerodynamic stability, second tether 1001 is severed, allowing biasing elements 603*a*, 603*b* to bias airfoils 303, 305 from the partially deployed positions toward the fully deployed positions. FIG. 12 illustrates, by way of example and illustration, one particular means for releasing airfoils 303, 305 from the partially deployed positions. In the illustrated embodiment, second tether 1001 is disposed through a second tether severing mechanism 1201. When activated, second tether severing mechanism 1201 severs second tether 1001, thus allowing biasing elements 601 bias airfoils 303, 305 to the fully deployed positions. In the illustrated embodiment, second tether severing mechanism 1201 has a construction comparable to that of first tether severing mechanism 703. Preferably, second tether severing mechanism 1201 is attached to body 307 of vehicle 301.

Figure 13A:
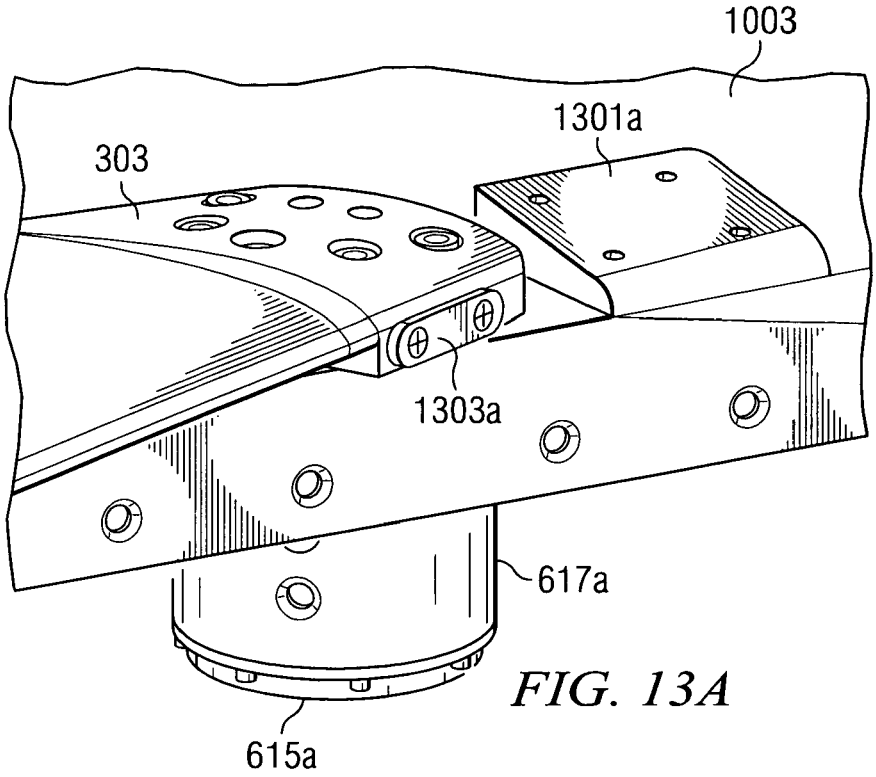
FIGS. 13A and 13B are perspective views of an illustrative embodiment of an impact plate and bumper of the present invention.
Figure 13B:
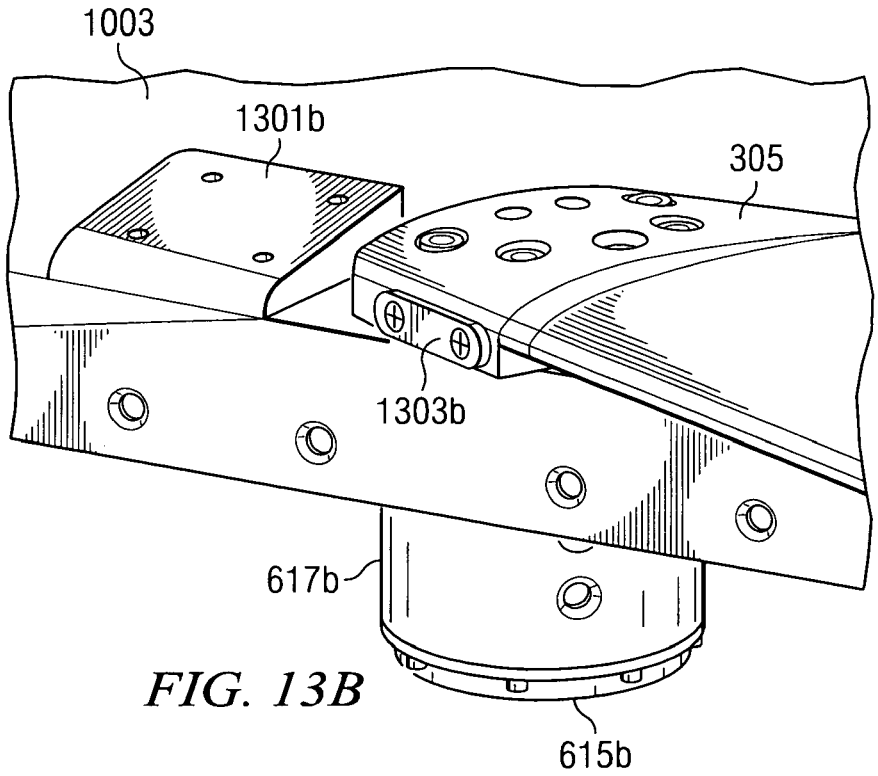

Referring now to FIGS. 13A and 13B, one embodiment of the present invention includes impact plates 1301*a*, 1301*b*, preferably attached to upper shell 1003 of body 307 of vehicle 301. In the illustrated embodiment, the present invention further includes bumpers 1303*a*, 1303*b* attached to airfoils 303, 305, respectively. Bumpers 1303*a*, 1303*b* are disposed on airfoils 303, 305 such that bumpers 1303*a*, 1303*b* contact the corresponding impact plates 1301*a*, 1301*b* when airfoils 303, 305 are released from the partially deployed positions and reach the fully deployed positions. Bumpers 1303*a*, 1303*b* cushion impacts between airfoils 303, 305 and impact plates 1301*a*, 1301*b*. In one embodiment, at least one of bumpers 1301*a*, 1301*b* comprises an elastic member or portion.

Referring again to FIGS. 6A and 6B, airfoils 303, 305 are rotationally attached to body 307 via clutch assemblies 605*a*, 605*b*, respectively. Clutch assemblies 605*a*, 605*b* inhibit rotational oscillations in airfoils 303, 305 as airfoils 303, 305 are biased toward the fully deployed positions. For example, when airfoils 303, 305 are released from the partially deployed positions and are biased to the fully deployed positions, clutch assemblies 605*a*, 605*b* dampen rotational oscillations of airfoils 303, 305 with respect to base 307. Thus, by way of example and illustration, clutch assemblies 605*a*, 605*b* are another means for damping oscillations in airfoils 303, 305. In embodiments wherein the present invention operates only one airfoil, such as airfoil 303 or 305, one of clutch assemblies 605*a* or 605*b*, respectively, represents one particular means for damping oscillations in the airfoil.

In the embodiment illustrated in FIGS. 13A and 13B, clutch assemblies 605*a*, 605*b* each comprise a clutch inner race 607*a*, 607*b*, a roller bearing clutch 609*a*, 609*b*, and a clutch race retainer 611*a*, 611*b*, respectively. Clutch inner race 607*a*, 607*b*, roller bearing clutch 609*a*, 609*b*, and clutch race retainer 611*a*, 611*b*, in combination, inhibit the rotational movement of airfoil 303 or airfoil 305 with respect to base 307. Forces applied to axles 601*a*, 601*b* to inhibit oscillations in airfoils 303, 305, however, are overcome by biasing elements 603*a*, 603*b* to bias airfoils 303, 305 toward the fully deployed positions. Bearings 613*a*, 613*b* mechanically support axles 601*a*, 601*b*, respectively. Clutch inner race 607*a*, 607*b*, roller bearing clutch 609*a*, 609*b*, clutch race retainer 611*a*, 611*b*, and bearings 613*a*, 613*b* are housed within cavities defined by roller clutch housings 615*a*, 615*b* and airfoil pivot housings 617*a*, 617*b*, respectively. In the illustrated embodiment, biasing elements 603*a*, 603*b* are attached between axles 601*a*, 601*b* and airfoil pivot housings 617*a*, 617*b*, respectively. Thus, in the illustrated embodiment, biasing elements 603*a*, 603*b* are operably associated with airfoils 303, 305, respectively, and body 307. Airfoil pivot housings 617*a*, 617*b* are preferably attached to body 307 of vehicle 301.

In the illustrated embodiment, fasteners 619*a*, 619*b* threadedly engage clutch race retainer 611*a*, 619*b*, respectively. It should be noted that disengaging fasteners 619*a*, 619*b* from clutch race retainer 611*a*, 611*b*, respectively, allows airfoils 303, 305, respectively to be moved toward the stowed positions.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered. within the scope and spirit of the invention. Accordingly, the protection sought herein is as set forth in the claims below. It is apparent that an invention with significant advantages has been described and illustrated. Although the present invention is shown in a limited number of forms, it is not limited to just these forms, but is amenable to various changes and modifications without departing from the spirit thereof.

What is claimed is:

1. An apparatus, comprising:

means for biasing a first airfoil of a vehicle toward a fully deployed position;

means for restraining the first airfoil in a stowed position;

means for releasing the first airfoil from the stowed position;

means for restraining the first airfoil in a partially deployed position;

means for releasing the first airfoil from the partially deployed position; and means for damping rotational oscillations in the first airfoil;

wherein the means for restraining the first airfoil in the partially deployed position comprises a second tether operably associated with the first airfoil and operably associated with one of a second airfoil and a body of the vehicle, the second tether comprising a cable and a fitting disposed proximate an end of the cable; and wherein the means for damping rotational oscillations in the first airfoil comprises an elastic tube disposed about the cable and abutting the fitting.

2. The apparatus, according to claim 1, wherein the means for restraining the first airfoil in the stowed position comprises:

a first tether operably associated with the first airfoil and operably associated with one of a second airfoil and a body of a vehicle.

3. The apparatus, according to claim 2, wherein the means for releasing the first airfoil from the stowed position comprises:

a first tether severing mechanism.

4. The apparatus, according to claim 3, wherein the first tether comprises a cable and the first tether severing mechanism is operable to sever the cable of the first tether.

5. The apparatus, according to claim 1, wherein the means for releasing the first airfoil from the partially deployed position comprises:

a second tether severing mechanism.

6. The apparatus, according to claim 5, wherein the second tether severing mechanism is operable to sever the cable of the second tether.

7. The apparatus, according to claim 1, wherein:

the elastic tube is a means for attenuating mechanical shock induced in the second tether.

8. The apparatus, according to claim 1, wherein the means for biasing the first airfoil toward the fully deployed position comprises:

a spirally-wound strip spring operably associated with the first airfoil and a body of the vehicle.

9. The apparatus, according to claim 1, wherein the means for damping rotational oscillations in the first airfoil further comprises:

a clutch assembly operably associated with the airfoil and a body of the vehicle.

10. An apparatus, comprising:

a biasing element operably associated with a first airfoil and a body of a vehicle operable to bias the first airfoil toward a fully deployed position;

a first tether operably associated with the first airfoil and one of a second airfoil and the body of the vehicle, the first tether operable to restrain the first airfoil in a stowed position;

a first tether severing mechanism operable to sever the first tether;

a second tether operably associated with the first airfoil and one of the second airfoil and the body of the vehicle, the second tether operable to restrain the first airfoil in a partially deployed position, the second tether comprising a cable having an end and a fitting disposed proximate the end;

a second tether severing mechanism operable to sever the second tether; and an elastic tube disposed about the cable and abutting the fitting.

11. The apparatus, according to claim 10, further comprising:

a clutch assembly operably associated with the first airfoil and the body of the vehicle operable to inhibit rotational oscillations in the first airfoil with respect to the body of the vehicle.

12. The apparatus, according to claim 10, wherein the first tether comprises a cable and the first tether severing mechanism is operable to sever the cable of the first tether.

13. The apparatus, according to claim 10, wherein the second tether severing mechanism is operable to sever the cable of the second tether.

14. An apparatus, comprising:

a biasing element operably associated with a first airfoil and a body of a vehicle operable to bias the first airfoil toward a fully deployed position;

a biasing element operably associated with a second airfoil and the body of a vehicle operable to bias the second airfoil toward a fully deployed position;

a first tether operably associated with the first airfoil and the second airfoil, the first tether operable to restrain the first airfoil and the second airfoil in stowed positions;

a first tether severing mechanism operable to sever the first tether;

a second tether operably associated with the first airfoil and the second airfoil, the second tether operable to restrain the first airfoil and the second airfoil in partially deployed positions, the second tether comprising a cable having a first end and a second end, the second tether further comprising a first fitting disposed proximate the first end and a second fitting disposed proximate the second end;

a second tether severing mechanism operable to sever the second tether;

a first elastic tube disposed about the cable and abutting the first fitting; and a second elastic tube disposed about the cable and abutting the second fitting.

15. The apparatus, according to claim 14, further comprising:

a first clutch assembly operably associated with the first airfoil and the body of the vehicle operable to inhibit rotational oscillations in the first airfoil with respect to the body of the vehicle.

16. The apparatus, according to claim 14, further comprising:

a second clutch assembly operably associated with the second airfoil and the body of the vehicle operable to inhibit rotational oscillations in the second airfoil with respect to the body of the vehicle.

* * * * *